US007257958B2

(12) United States Patent
Bush et al.

(10) Patent No.: US 7,257,958 B2
(45) Date of Patent: Aug. 21, 2007

(54) MULTI-TEMPERATURE COOLING SYSTEM

(75) Inventors: James W. Bush, Skaneateles, NY (US); Steven J. Holden, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 266 days.

(21) Appl. No.: 10/798,586

(22) Filed: Mar. 10, 2004

(65) Prior Publication Data

US 2005/0198997 A1 Sep. 15, 2005

(51) Int. Cl.
*F25B 5/00* (2006.01)
*F25B 1/10* (2006.01)
*F25B 41/00* (2006.01)

(52) U.S. Cl. ..... 62/199; 62/510; 62/513

(58) Field of Classification Search ..... 62/199, 62/200, 510, 513, 113
See application file for complete search history.

(56) References Cited

U.S. PATENT DOCUMENTS

| | | | | | |
|---|---|---|---|---|---|
| 2,095,009 | A * | 10/1937 | Philipp | ..... | 62/510 |
| 2,228,834 | A * | 1/1941 | Kramer, Jr. | ..... | 62/200 |
| 2,481,605 | A * | 9/1949 | MacLeod | ..... | 62/510 |
| 3,108,453 | A * | 10/1963 | Tinkey | ..... | 62/200 |
| 3,577,742 | A * | 5/1971 | Kocher | ..... | 62/199 |
| 4,005,949 | A * | 2/1977 | Grant | ..... | 418/15 |
| 4,193,270 | A | 3/1980 | Scott | | |
| 5,065,591 | A | 11/1991 | Shaw | | |
| 6,474,087 | B1 * | 11/2002 | Lifson | ..... | 62/513 |

* cited by examiner

*Primary Examiner*—Marc Norman
(74) *Attorney, Agent, or Firm*—Bachman & LaPointe, P.C.

(57) ABSTRACT

A refrigeration system has first and second evaporators which may be operated at first and second temperatures. Refrigerant from a lower temperature evaporator may be returned to a compressor suction port. Refrigerant from the higher temperature evaporator may be returned to an intermediate port.

14 Claims, 2 Drawing Sheets

MULTI-TEMPERATURE COOLING SYSTEM

BACKGROUND OF THE INVENTION (1) Field of the Invention

The invention relates to cooling. More particularly, the invention relates to multi-temperature cooling systems.

(2) Description of the Related Art

Multi-temperature cooling systems are known in the art. Such systems cool multiple locations to multiple different temperatures. A separate evaporator may be located at each location. U.S. Pat. No. 5,065,591 illustrates a multi-temperature system featuring several compressors and a single condenser.

SUMMARY OF THE INVENTION

One aspect of the invention involves an apparatus comprising a compressor having an inlet and an outlet and at least a first port between the inlet and outlet. A condenser has an inlet coupled to the compressor outlet to receive refrigerant and has an outlet. A first evaporator has an inlet coupled to the condenser to receive refrigerant and has an outlet coupled to the compressor inlet. A second evaporator has an inlet coupled to the condenser to receive refrigerant and has an outlet coupled to the compressor first port to return refrigerant to the compressor, bypassing a compression path between the compressor inlet and first port.

In various implementations, the compressor may be a screw- or scroll-type compressor. At least one heat exchanger may exchange heat from refrigerant discharged by the condenser to refrigerant discharged by at least one of the first and second evaporators. A first heat exchanger may exchange heat from refrigerant discharged by the condenser to refrigerant discharged by the first evaporator and a second heat exchanger may exchange heat refrigerant from discharged by the condenser to refrigerant discharged by the second evaporator. A donor conduit of the first heat exchanger may be downstream of a donor conduit of the second heat exchanger along a refrigerant flowpath portion extending downstream from the condenser. A refrigerant flowpath portion may extend downstream from the condenser and branch into: a first branch through a donor conduit of the first heat exchanger, the first evaporator, and a recipient conduit of the first heat exchanger; and a second branch through a donor conduit of the second heat exchanger, the second evaporator, and a recipient conduit of the second heat exchanger. An economizer may have a flowpath segment from upstream of the first and second evaporators to downstream of the second evaporator.

Another aspect of the invention involves an apparatus comprising means for compressing a refrigerant having a compression path between inlet and outlet ports and an intermediate port at an intermediate location along the compression path. The apparatus also has a condenser and first and second evaporators. The apparatus also has means for coupling the inlet, outlet, and intermediate ports, condenser, and first and second evaporators so as to operate the first evaporator at a first temperature and the second evaporator at a second temperature, lower than the first temperature. In various implementations, the means for compressing may consist essentially of a single compressor.

Another aspect of the invention involves a method for cooling first and second locations. A refrigerant is compressed with a compressor having a compression path between an inlet port and an outlet port. The compressed refrigerant is condensed. A first portion of the condensed refrigerant is evaporated in a first evaporator at a first temperature to cool the first location. A second portion of the condensed refrigerant is evaporated in a second evaporator at a second temperature, higher than the first temperature, to cool the second location. At least a portion of refrigerant is returned from the first evaporator to the inlet port of the compressor. At least a portion of the refrigerant is returned from the second evaporator to a first port, intermediate the compressor inlet and outlet ports along the compression path. In various implementations, an economizer portion of the refrigerant may be diverted to bypass at least one of the first and second evaporators.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
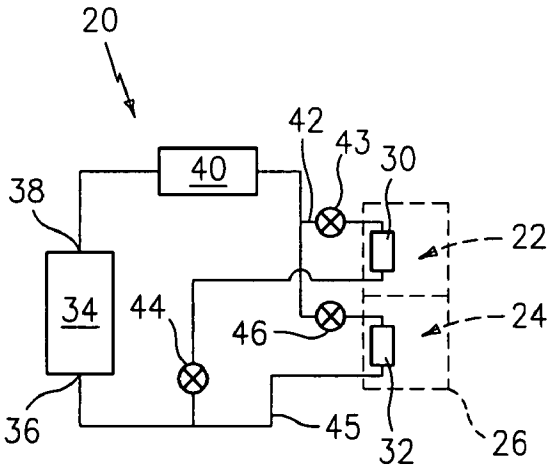
FIG. 1 (PRIOR ART)
FIG. 1 is a schematic view of a prior art system.

FIG. 1 shows a prior art system 20 for cooling first and second locations (spaces/volumes) 22 and 24. Exemplary first and second locations are higher and lower temperature compartments of a refrigerated container 26. In the exemplary system, first and second evaporators 30 and 32 are respectively located within the compartments. To provide refrigerant to the evaporators, a single compressor 34 receives refrigerant through a suction (inlet) port 36 and discharges the refrigerant through a discharge (outlet) port 38. From the discharge port, the refrigerant passes to a condenser 40. From the condenser, the refrigerant output branches to split between the evaporators. A first branch 42 extends through a first expansion valve 43, the first evaporator 30, and a throttle valve 44. A second branch 45 runs through a second expansion valve 46 and the second evaporator 32 before joining the first branch to return to the suction port 36. Refrigerant exiting the low temperature evaporator 32 may thus return directly to the suction port 36. Refrigerant exiting the higher temperature evaporator 30 passes through the throttle valve 44 before returning to the suction port. By operating at a higher temperature, the evaporator 30 outputs refrigerant at a higher temperature and pressure than does the lower temperature evaporator 32. The valve 44 provides a step down between the two pressures. The throttling process associated with the valve 44 represents an inefficiency.

Figure 2:
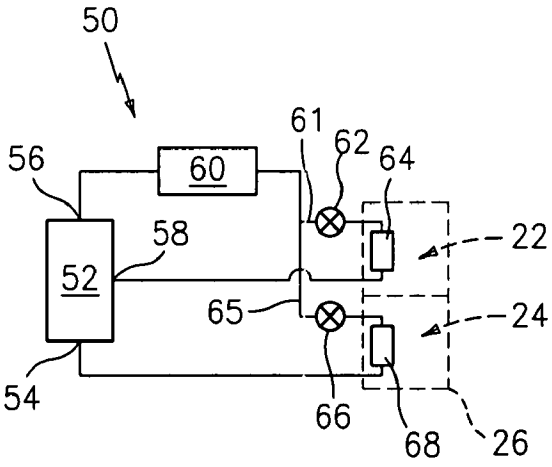
FIG. 2 is a schematic view of a first system according to principles of the invention.

FIG. 2 shows an alternate system 50 for cooling the locations 22 and 24. The system includes a compressor 52 having suction and discharge ports 54 and 56 defining a compression path therebetween. At an intermediate location along the compression path, the compressor includes an intermediate port 58. Refrigerant discharged from the discharge port 56 passes through a condenser 60 and, there-from, is split along two branches. A first branch 61 passes through a first expansion valve 62 and a high temperature evaporator 64 and returns to the intermediate port 58. A second branch 65 passes through an expansion valve 66 and a low temperature evaporator 68 and returns to the suction port 54. The location of the intermediate port 58 along the compression path is chosen so that the pressure at this port will correspond to the desired outlet pressure of the high temperature evaporator. With screw-type and scroll-type compressors, there may be broad freedom to optimize the exact location of the intermediate port and potentially configure the compressor so that one or more of several locations may be selected during or after installation. With reciprocating compressors, the intermediate port may conveniently be located in the interstage of a multistage implementation. In such a situation, the sizes of the stages may be chosen to provide a desired intermediate pressure.

Figure 3:
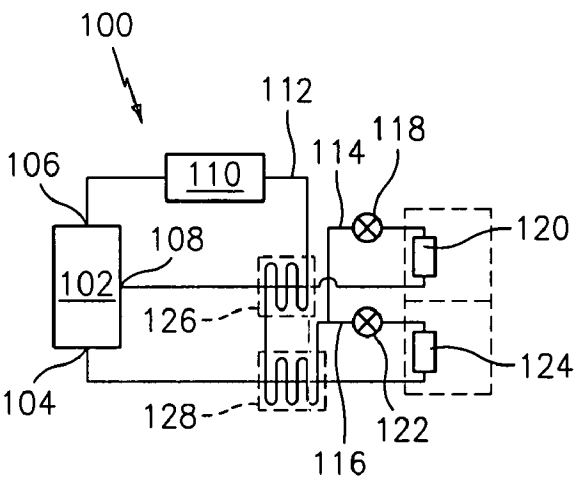
FIG. 3 is a schematic view of a second system according to principles of the invention.

FIG. 3 shows an alternate system 100 having a compressor 102 with suction, discharge, and intermediate ports 104, 106, and 108. The condenser 110 has an output conduit with a trunk 112 and branches 114 and 116. The high temperature expansion valve 118 and high temperature evaporator 120 are located in the branch 114 and the low temperature expansion valve 122 and low temperature evaporator 124 are located in the branch 116. In the exemplary embodiment, portions of the trunk 112 are in heat exchange relationship with portions of the branches 114 and 116 downstream of their associated evaporators. FIG. 3 shows this in the form of exemplary heat exchangers 126 and 128 including heat donor lengths of the trunk conduit and heat recipient lengths of the branch conduit, respectively. Along the trunk conduit, the first heat exchanger 126 is upstream of the second heat exchanger 128. The heat exchangers are crossflow, parallel flow, or counterflow heat exchangers and as shown illustrate examples of liquid-to-suction heat exchangers (LSHX) which are commonly used in refrigeration systems. In refrigeration systems with long suction lines back to the compressor or with poorly insulated suction lines or in a hot environment, there will be heat transfer from the environment into the cool suction gas flowing back to the compressor. This reduces the density of the suction gas entering the compressor and, since the compressor delivers a fixed volume flow, results in a reduction of mass flow of refrigerant through the system. This has the net result of lost cooling capacity essentially equivalent to the heat transfer into the suction line. The liquid entering the expansion valve from the condenser is often at a temperature higher than the environment and any cooling of this liquid prior to entering the expansion valve and evaporator represents increased cooling capacity in the system. The LSHX cools the liquid entering the expansion valve by transferring heat energy to the suction gas leaving the evaporator. This warms the suction gas to near-ambient levels so there is little or no additional heat transfer as the gas travels back to the compressor. The cooler liquid entering the expansion valve and evaporator result in a net increase in cooling capacity. The cooling ability of the suction gas leaving the evaporator is thus harnessed to boost system capacity instead of being lost in the suction line on the way back to the compressor. This results in improved system efficiency (this all takes place with no additional compressor power) and allows for a smaller (e.g., less expensive) system to carry the cooling load.

Figure 4:
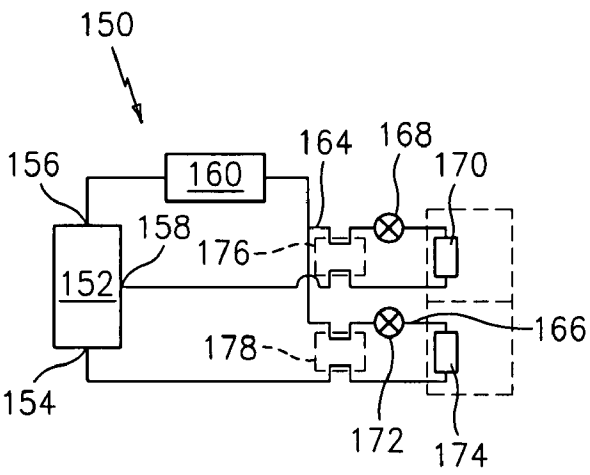
FIG. 4 is a schematic view of a third system according to principles of the invention.

FIG. 4 shows a system 150 having a compressor 152 with suction, discharge, and intermediate ports 154, 156 and 158 and a condenser 160 which may be similar to those of FIG. 3. High and low temperature expansion valves 168 and 172 and evaporators 170 and 174 also may be similar to those of FIG. 3. In the system 150, however, heat exchange is between portions of the branches 164 and 166 upstream and downstream of the valve/evaporator combinations in heat exchangers 176 and 178.

Figure 5:
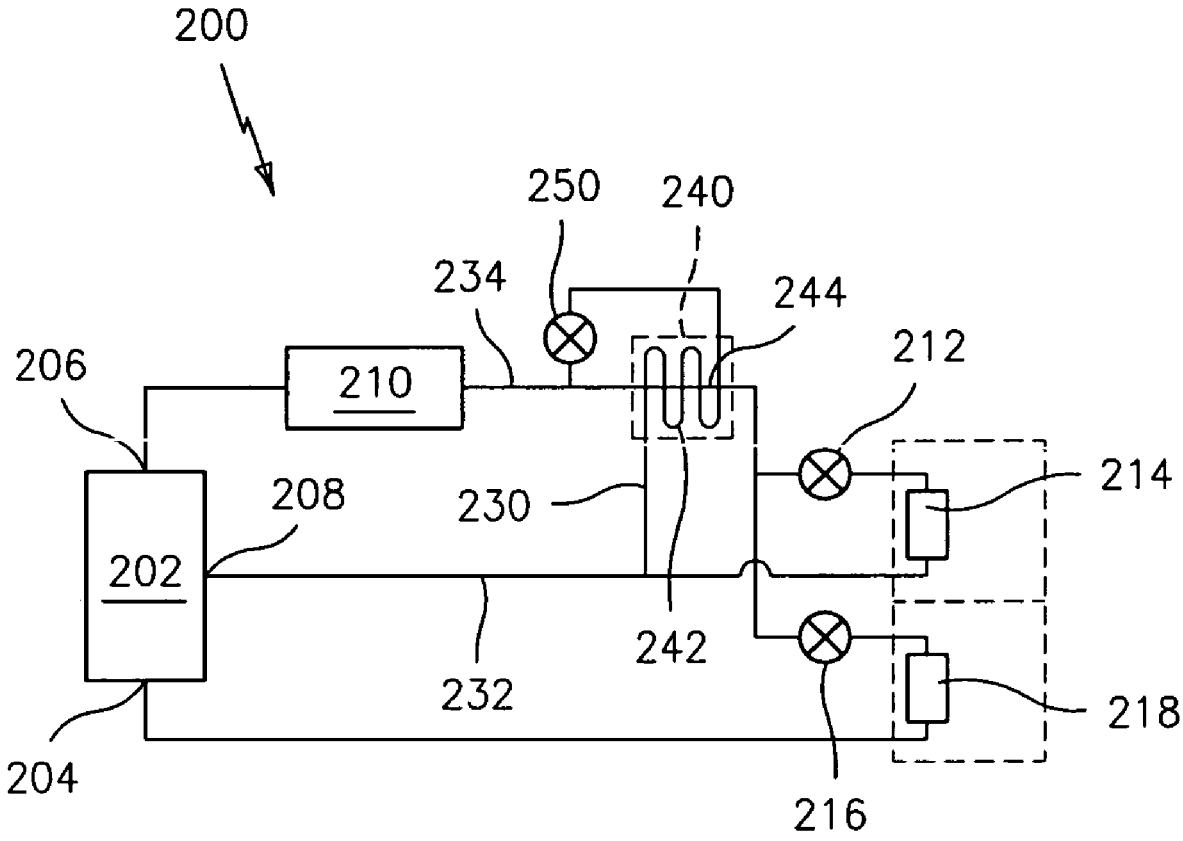
FIG. 5 is a schematic view of a fourth system according to principles of the invention.

Among various modifications are the addition of one or more economizers. FIG. 5 shows a system 200 wherein the compressor 202 has ports 204, 206, and 208 which may be generally similar to those of FIG. 2. Similarly, the condenser 210, high and low temperature expansion valves 212 and 216, and high and low temperature evaporators 214 and 218 may be similar. The system 200 includes an economizer bypass conduit 230 extending from the high temperature branch 232 between the high temperature evaporator 214 and intermediate port 208 to the trunk 234. An economizer heat exchanger 240 contains a heat recipient length 242 of the conduit 230 and a heat donor length 244 of the trunk 234. An economizer expansion valve 250 is formed in the conduit 230 between the length 242 and the junction with the trunk 234. In operation, the cooling capacity of refrigerant which is diverted through economizer bypass conduit 230 is used to provide additional cooling to the main liquid flow through the trunk 234. This cooled main flow, which proceeds to the evaporators, provides increased cooling capacity. The vapor in the bypass conduit 230, which is at an intermediate pressure higher than the low temperature evaporator 218 pressure, is returned to the intermediate pressure compressor port 208 and recompressed as part of the main flow. Because only a partial compression is needed, the incremental compression power required for the increased evaporator capacity is only a part of the compression power that would be needed if a conventional circuit was used. Thus use of the economizer circuit provides increased system capacity with a less than proportional increase in power and improved overall efficiency. In a refrigeration cycle, this improvement can be quite large (e.g., ten to thirty percent or more). Alternatively, the economizer can permit a given or more moderately increased capacity to be achieved with a smaller system or can otherwise balance capacity, efficiency and size.

One or more embodiments of the present invention have been described. Nevertheless, it will be understood that various modifications may be made without departing from the spirit and scope of the invention. For example, the principles may be applied as modifications of various existing or yet-to-be developed systems. When implemented as a modification, details of the original system may influence details of any particular implementation. Accordingly, other embodiments are within the scope of the following claims.

What is claimed is:

1. An apparatus comprising:

a compressor having an inlet and an outlet and at least a first port between the inlet and outlet;

a condenser having an inlet coupled to the compressor outlet to receive refrigerant and having an outlet;

a first evaporator having an inlet coupled to the condenser to receive refrigerant and having an outlet coupled to the compressor inlet;

a second evaporator having an inlet coupled to the condenser to receive refrigerant and having an outlet coupled to the compressor first port to return refrigerant to the compressor, bypassing a compression path between the compressor inlet and first port;

a first heat exchanger exchanging heat from refrigerant discharged by the condenser to refrigerant discharged by the first evaporator; and a second heat exchanger exchanging heat from refrigerant discharged by the condenser to refrigerant discharged by the second evaporator, a donor conduit of the first heat exchanger being downstream of a donor conduit of the second heat exchanger along a refrigerant flowpath portion extending downstream from the condenser.

2. The apparatus of claim 1 wherein:

the compressor is a screw-type compressor.

3. The apparatus of claim 1 wherein:

the compressor is a scroll-type compressor.

4. The apparatus of claim 1 wherein:

the first and second evaporators are respectively in first and second compartments of a container.

5. An apparatus comprising:

a compressor having an inlet and an outlet and at least a first port between the inlet and outlet;

a condenser having an inlet coupled to the compressor outlet to receive refrigerant and having an outlet;

a first evaporator having an inlet coupled to the condenser to receive refrigerant and having an outlet coupled to the compressor inlet;

a second evaporator having an inlet coupled to the condenser to receive refrigerant and having an outlet coupled to the compressor first port to return refrigerant to the compressor, bypassing a compression path between the compressor inlet and first port;

a first heat exchanger exchanging heat from refrigerant discharged by the condenser to refrigerant discharged by the first evaporator; and a second heat exchanger exchanging heat from refrigerant discharged by the condenser to refrigerant discharged by the second evaporator, wherein:

a refrigerant flowpath portion extending downstream from the condenser branches into:

a first branch through a donor conduit of the first heat exchanger, the first evaporator, and a recipient conduit of the first heat exchanger; and a second branch through a donor conduit of the second heat exchanger, the second evaporator, and a recipient conduit of the second heat exchanger.

6. The apparatus of claim 5 wherein:

the compressor is a screw-type compressor.

7. The apparatus of claim 5 wherein:

the compressor is a scroll-type compressor.

8. The apparatus of claim 5 wherein:

the first and second evaporators are respectively in first and second compartments of a container.

9. An apparatus comprising:

a compressor having an inlet and an outlet and at least a first port between the inlet and outlet;

a condenser having an inlet coupled to the compressor outlet to receive refrigerant and having an outlet;

a first evaporator having an inlet coupled to the condenser to receive refrigerant and having an outlet coupled to the compressor inlet;

a second evaporator having an inlet coupled to the condenser to receive refrigerant and having an outlet coupled to the compressor first port to return refrigerant to the compressor, bypassing a compression path between the compressor inlet and first port; and an economizer having a flowpath segment from upstream of the first and second evaporators to downstream of the second evaporator.

10. The apparatus of claim 9 wherein:

the compressor is a screw-type compressor.

11. The apparatus of claim 9 wherein:

the compressor is a scroll-type compressor.

12. The apparatus of claim 9 wherein:

the first and second evaporators are respectively in first and second compartments of a container.

13. A method for cooling first and second locations comprising:

compressing a refrigerant with a compressor having a compression path between an inlet port and an outlet port;

condensing the compressed refrigerant;

evaporating a first portion of the condensed refrigerant in a first evaporator at a first temperature to cool the first location;

evaporating a second portion of the condensed refrigerant in a second evaporator at a second temperature, higher than the first temperature, to cool the second location;

returning at least a portion of refrigerant from the first evaporator to the inlet port of the compressor;

returning at least a portion of the refrigerant from the second evaporator to a first port, intermediate the compressor inlet and outlet ports along the compression path; and diverting an economizer portion of the refrigerant to bypass at least one of the first and second evaporators.

14. The method of claim 13 wherein:

the first and second locations are respectively first and second compartments of a container.

* * * * *